US006128455A

United States Patent [19]

Horiguchi et al.

[11] Patent Number: 6,128,455

[45] Date of Patent: Oct. 3, 2000

[54] AUTOMATIC DOCUMENT FEEDER HAVING AN OPEN-AND-CLOSE COVER

[75] Inventors: Shigeru Horiguchi, Kawasaki; Yuki Nanri, Ohta-ku; Kazuyuki Saito, Kita-ku, all of Japan

[73] Assignee: Ricoh Company, Ltd., Tokyo, Japan

[21] Appl. No.: 09/288,810

[22] Filed: Apr. 9, 1999

[30] Foreign Application Priority Data

Apr. 13, 1998 [JP] Japan ..... 10-100995

[51] Int. Cl.[7] ..... G03G 15/00

[52] U.S. Cl. ..... 399/124; 399/107; 399/125; 399/367

[58] Field of Search ..... 399/124, 125, 399/107, 110, 21, 22, 367, 17; 358/474, 498; 355/75

[56] References Cited

U.S. PATENT DOCUMENTS

| | | | |
|---|---|---|---|
| 5,200,790 | 4/1993 | Irie et al. | 399/17 |
| 5,363,184 | 11/1994 | Matsuo et al. | 399/367 |
| 5,534,989 | 7/1996 | Rubscha et al. | 399/107 X |
| 5,844,687 | 12/1998 | Nagane et al. | 399/107 X |

FOREIGN PATENT DOCUMENTS

| | | |
|---|---|---|
| 3-8674 | 1/1991 | Japan . |
| 4-86755 | 3/1992 | Japan . |
| 4-145456 | 5/1992 | Japan . |
| 7-193672 | 7/1995 | Japan . |
| 9-236949 | 9/1997 | Japan . |

*Primary Examiner*—Sophia S. Chen
*Attorney, Agent, or Firm*—Oblon, Spivak, McClelland, Maier & Neustadt, P.C.

[57] ABSTRACT

An automatic document feeder includes a document-loading device that loads a plurality of sheets of a document thereupon. A document-receiving device is arranged below the document-loading device and receives and stacks sheets of the document one by one, which have been transported from the document-loading device. A sheet-guiding device guides transportation of a sheet of the document from the document-loading device to the document-receiving device. A sheet-transporting device transports a sheet of the document one by one along the sheet-guiding device from the document-loading device to the document-receiving device. An open-and-close cover covers and exposes an upper portion and a side of the sheet-guiding device and the sheet-transporting device. A rotative connecting device connects the open-and-close covering device and the body of the automatic document feeder at a rear part thereof such that the open-and-close cover opens upward in a direction perpendicular to a sheet-transporting-direction by the sheet-transporting device.

19 Claims, 12 Drawing Sheets

AUTOMATIC DOCUMENT FEEDER HAVING AN OPEN-AND-CLOSE COVER

BACKGROUND OF THE INVENTION

1. Field of the Invention

The present invention relates to an automatic document feeder for an image processing apparatus such as a photocopier, a facsimile machine, an image scanner, and the like, and more particularly to an automatic document feeder having an open-and-close cover for removing a jammed document.

2. Discussion of the Background

At the same time that image processing apparatuses such as photocopiers, facsimile machines, image scanners, and the like, are being improved in their performance, such as in processing speeds and processing functions, a demand for a reduction in the installation space of such image processing apparatuses has also increased. In particular, an automatic document feeder is desired to be more compact.

FIG. 1 is a schematic view illustrating a structure of an exemplary automatic document feeder 106 according to a background art. In FIG. 1, the automatic document feeder 106 is mounted on an image processing apparatus 101, and includes a document-feeding tray 109, a document-receiving tray 118, a feed-in roller 110, a first transport roller pair 111, a second transport roller pair 113, an exit roller pair 117, paper paths 114A, 114B, and 114C, an open-and-close cover 122 with a hole 122H, and a stationary shaft 122P. The stationary shaft 122P is arranged parallel to axes of the feed-in roller 110, the first transport roller pair 111, the second transport roller pair 113, and the exit roller pair 117, and is fixed on a frame (not shown) of the automatic document feeder 106. The open-and-close cover 122 can be rotatively opened toward the left side in FIG. 1 around the shaft 122P, as indicated by the path of arrow 122T. The document-feeding tray 109 loads a stack of documents P1. The document-receiving tray 118 is placed under the document-feeding tray 109 for receiving and stacking documents P2 one by one which are sequentially fed out from the document-feeding tray 109. The paper path 114C includes a window 150 that is provided such that the image processing apparatus 101 can read image information of the document being transported through the path 114C through the window 150. The feed-in roller 110, the first transport roller pair 111, the second transport roller pair 113, and the exit roller pair 117 are arranged along a path including the paper paths 114A, 114B, and 114C in which a document fed from the document-feeding tray 109 is conveyed to the document-receiving tray 118.

The feed-in roller 110 pulls a sheet of a document out from the stack of the documents P1 on the document-feeding tray 109 and feeds the sheet of a document into the paper path 114A. The first transport roller pair 111, the second transport roller pair 113, and the exit roller pair 117 transport the sheet through the paper paths 114B and 114C to the document-receiving tray 118. A sheet of a document on the way from the document-feeding tray 109 to the document-receiving tray 118 may jam in the paths 114A, 114B or 114C, and the jammed sheet then has to be removed.

In a case of such a jam, an operator of the automatic document feeder can open the open-and-close cover 122 toward the left side as indicated by the arrow path 122T in FIG. 1, and thereby the operator can expose the paper paths 114A and 114B and remove the jammed sheet of a document. However, such an open-and-close cover 122 requires a certain extra space, for example, a space W2 as shown in FIG. 1, to be opened for removing the jammed paper. This space W2 is on the left side of the automatic document feeder 106 in FIG. 1. Therefore, despite the fact that the width of the automatic document feeder 106 and the image processing apparatus 101 is W1 as shown in FIG. 1, an area with the total width of W1+W2 is required for installing the image processing apparatus 101 with the automatic document feeder 106 on a desk or a floor. Further, in adjacent to the rotating pivot of the open-and-close cover 122, a space in front of the lower part of the paper path 114B is apt to be small, in which case it may be difficult to remove a jammed sheet.

SUMMARY OF THE INVENTION

The novel present invention has been made in view of the above-discussed and other problems, and has as one objective to overcome the above-discussed and other problems with background apparatuses.

Accordingly, a preferred embodiment of the present invention provides a novel automatic document feeder that is capable of being utilized in a relatively small space with enough room secured for removing a jammed sheet of a document.

A preferred embodiment of the present invention further provides a novel automatic document feeder that has improved operability for a jammed document recovery.

One embodiment of a novel automatic document feeder of the present invention includes a document-loading device that loads a plurality of sheets of a document thereupon. A document-receiving device is arranged below the document-loading device and receives and stacks sheets of the document one by one, which have been transported from the document-loading device. A sheet-guiding device guides transportation of a sheet of a document from the document-loading device to the document-receiving device. A sheet-transporting device transports a sheet of a document one by one along the sheet-guiding device from the document-loading device to the document-receiving device. An open-and-close covering device covers and exposes an upper portion and a side of the sheet-guiding device and the sheet-transporting device. A rotative connecting device connects the open-and-close covering device and the body of the automatic document feeder at a rear part thereof such that the open-and-close covering device opens upward in a direction perpendicular to a sheet-transporting-direction by the sheet-transporting device.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENT

Figure 1:
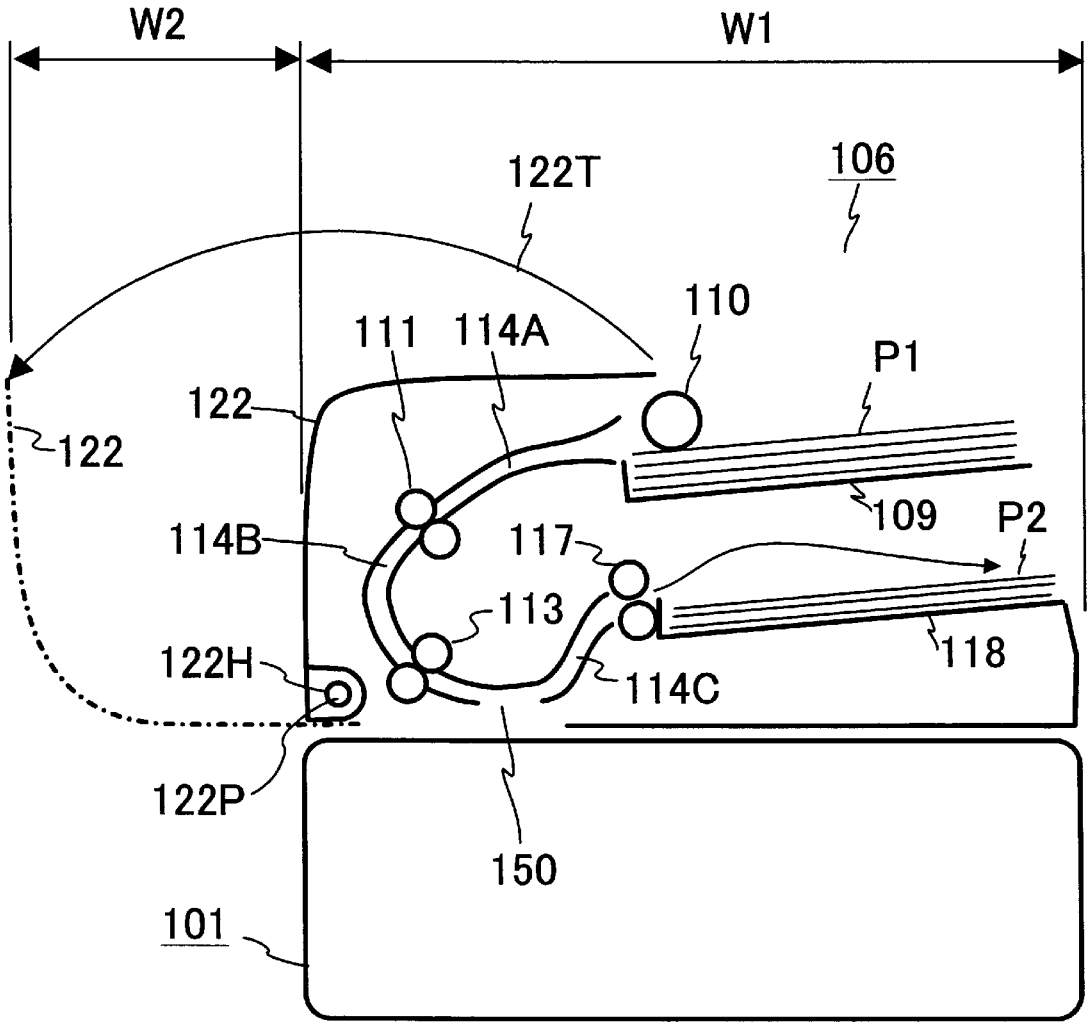
FIG. 1 (Background Art)
FIG. 1 is a schematic view illustrating a structure of an automatic document feeder according to a background art.

Automatic document feeders according to preferred embodiments of the present invention are now described in the figures in which like reference numerals indicate identical or corresponding parts throughout the several views.

Figure 2:
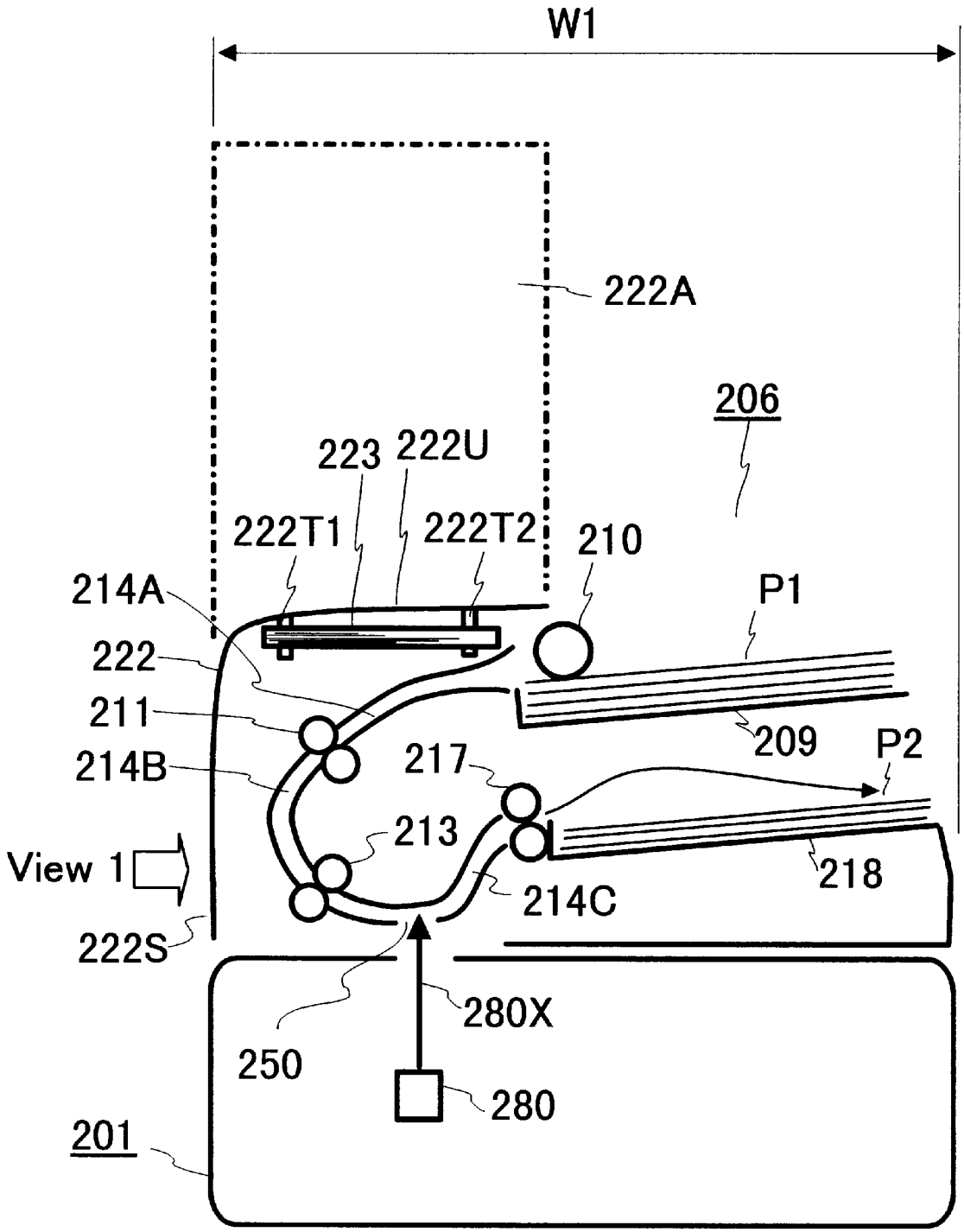
FIG. 2 is a schematic view illustrating a structure of an automatic document feeder according to a first embodiment of the present invention.
Figure 3:
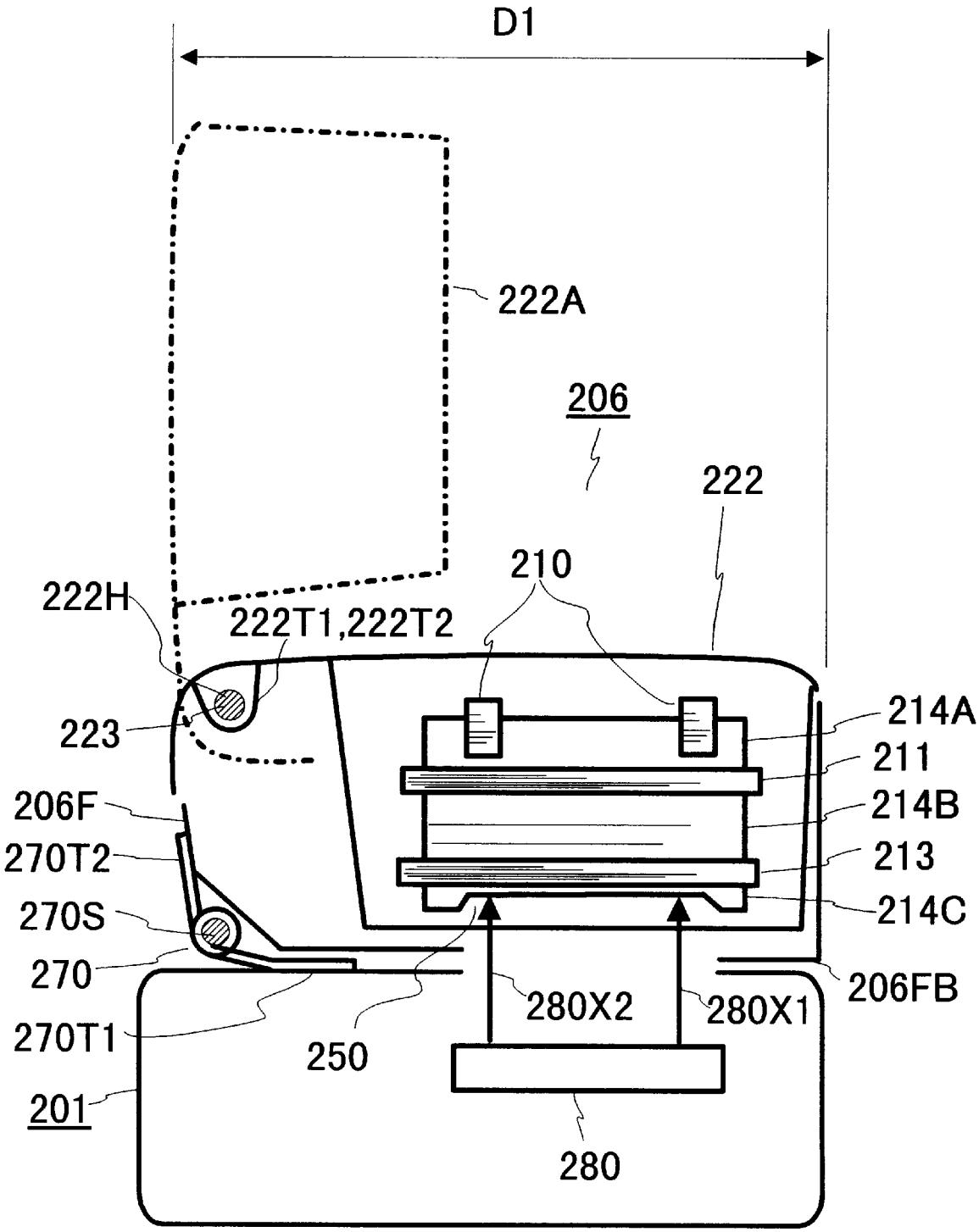
FIG. 3 is a lateral schematic view of the automatic document feeder of FIG. 1.

FIG. 2 and FIG. 3 are schematic views illustrating a structure of an automatic document feeder 206 according to one embodiment of the present invention. Referring to FIG. 2, the automatic document feeder 206 is mounted on an image scanner 201 as an example of an image processing apparatus. The automatic document feeder 206 includes a document-feeding tray 209, a document-receiving tray 218, a feed-in roller 210, a first transport roller pair 211, a second transport roller pair 213, an exit roller pair 217, paper paths 214A, 214B, and 214C, an open-and-close cover 222, a stationary shaft 223, and a hinge 270.

The open-and-close cover 222 has an upside down L-shaped cross-section for covering the first transport roller pair 211, the second transport roller pair 213, and paper paths 214A and 214B with face 222U and face 222S of the open-and-close cover 222. Further, the open-and-close cover 222 has two tabs 222T1 and 222T2 at a rear side thereof each having a hole 222H for rotatively fitting to the stationary shaft 223. The stationary shaft 223 is fixed on the frame 206F of the automatic document feeder 206 in a direction perpendicular to the axis of feed-in roller 210 and functions as a pivot for the rotation of the open-and-close cover 222. Thereby, the cover 222 can be rotatively opened upward as illustrated with a dot-dash line as opened cover 222A in FIG. 2 and FIG. 3.

Referring to FIG. 3, the hinge 270 connects the automatic document feeder 206 and the image scanner 201 such that the automatic document feeder 206 rotates around the hinge 270. The hinge 270 may have a structure as in a metal hinge of a door, and a plate 270T1 is fixed on the image scanner 201 and another plate 270T2 is fixed to a rear side of the automatic document feeder 206 with fasteners, such as screws. Therefore, the automatic document feeder 206 can be rotatively opened by as much as, for example, a 50 degree angle by lifting its bottom 206FB of the automatic document feeder 206. In addition, the axis 270S of the hinge 270 and the stationary shaft 223 are arranged in parallel, and thereby, both operations of opening the open-and-close cover 222 and opening the automatic document feeder 206 can be done in a similar manner, in other words, in a way that gives less confusion to operator in both opening operations.

Referring to FIG. 2, the document-feeding tray 209 loads a stack of documents P1. The document-receiving tray 218 is placed under the document-feeding tray 209 for receiving the documents one by one, which have been sequentially fed out from the document-feeding tray 209. The paper path 214C includes a window 250 that is provided such that the image scanner 201 reads information carried on the document, which is being transported through the window 250. The feed-in roller 210, the first transport roller pair 211, the second transport roller pair 213, and the exit roller pair 217 are arranged along a path including the paper paths 214A, 214B, and 214C. The feed-in roller 210 pulls a sheet out from the stack of the documents P1 on the document-feeding tray 209, and feeds the sheet to the first transport roller pair 211 through the paper path 214A. The first transport roller pair 211, the second transport roller pair 213, and the exit roller pair 217 sequentially transport the sheet through the paper paths 214B and 214C into the document-receiving tray 218.

The image scanner 201 includes a line-image-sensor 280 such as, for example, a charge-coupled-device, for scanning a widthwise line of the document to read the information carried on the line. The widthwise direction 280X or scanning direction of the line-image-sensor 280 is perpendicular to the surface of the sheet of FIG. 2 and the scanning width is indicated by a scanning start point 280X1 and a scanning end point 280X2 in FIG. 3. The line-image-sensor 280 reads information from the leading edge to the trailing edge of the document, line by line, while the document is being transported through the window 250.

A sheet of a document on its way from the document-feeding tray 209 to the document-receiving tray 218 may jam in the paper paths 214A, 214B or 214C. When such a document jam occurs, an operator of the automatic document feeder can open the open-and-close cover 222 upward as illustrated with the dash-dot-line to the opened position of the open-and-close cover 222A in FIG. 2 and FIG. 3. Thereby, a jammed sheet document, the paper paths 214A, 214B, the feed-in roller 210, the first transport roller pair 211, and the second transport roller pair 213 are exposed, and the operator can remove the jammed document. As shown in FIG. 2 and FIG. 3, the open-and-close cover 222 opens without extending into an extra space, such as space W2 in FIG. 1, outside the space the automatic document feeder 206 occupies. In other words, the installation space for the automatic document feeder 206 does not exceed the width W1 and depth D1 of the automatic document feeder 206 as shown in FIG. 2 or FIG. 3, without impairment of an operability of removing a jammed sheet.

Figure 4:
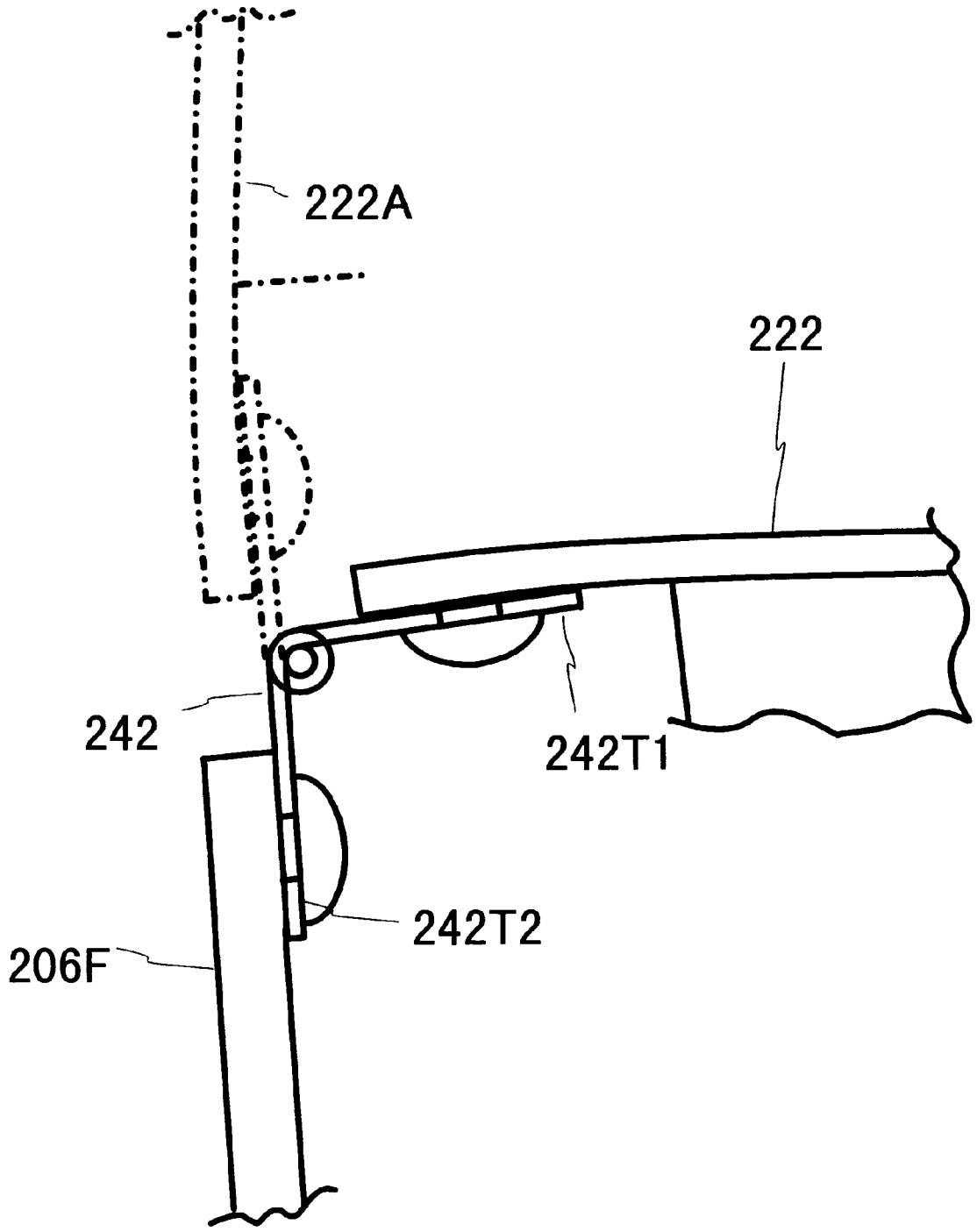
FIG. 4 is a schematic view illustrating a hinge connecting an open-and-close cover to the body of the automatic document feeder according to the present invention.

As shown in FIG. 4, as the hinge of the open-and-close cover 222, a metal hinge 242, which is often used for a door or a lid, can be utilized. In this case, the hinge 242 includes two plates 242T1 and 242T2 each having a curled end. A pin (not shown) is inserted through both of the curled portions of the plates 242T1 and 242T2 to connect the plates 242T1 and 242T2 together. The plate 242T1 is fixed on the open-and-close cover 222 and the other plate 242T2 is fixed at a rear of the frame 206F of the automatic document feeder 206 with fasteners, for example rivets.

Figure 5:
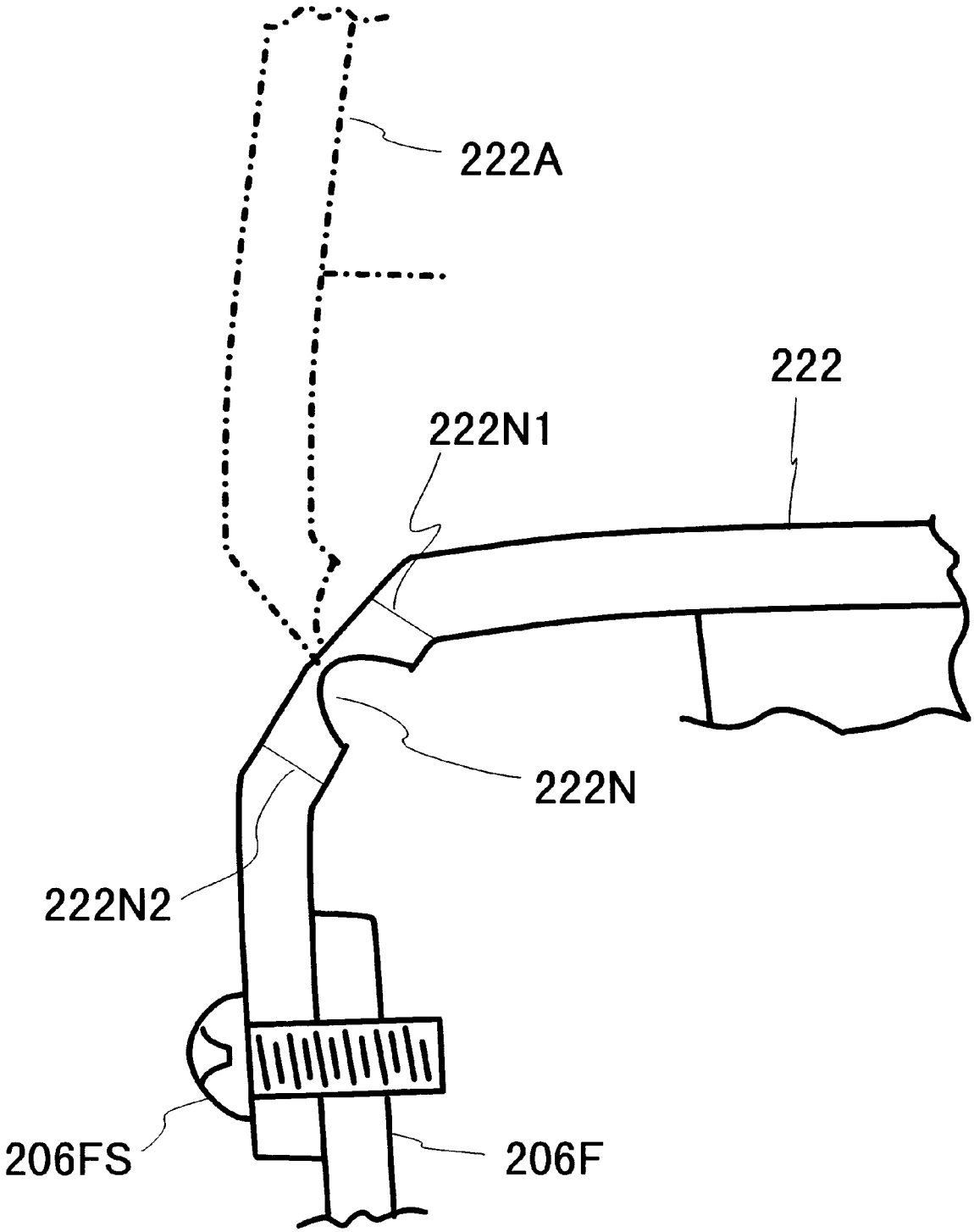
FIG. 5 is a schematic view illustrating another hinge for connecting the open-and-close cover to the body of the automatic document feeder according to the present invention.

Further, and as shown in FIG. 5, the open-and-close cover 222 and the hinge can be molded as an integrated part. In this case, the open-and-close cover 222 includes a hinge portion 222N functioning as a hinge at a rear end side of the open-and-close cover 222. For molding such an integrated part, a plastic material, such as, for example, polypropylene, can be utilized to obtain a good durability against multiple bending without cracking. Moreover, the integrated open-and-close cover 222 can be molded at a time with two different kinds of plastic materials, such as, for example, polypropylene, for a portion between 222N1 and 222N2 in FIG. 5, and acrylonitrile-butadiene-styrene for the other portion. The hinge 202 can be attached to the frame 206F by a fastener 206FS such as a screw. This method of molding provides cost reduction.

Figure 6:
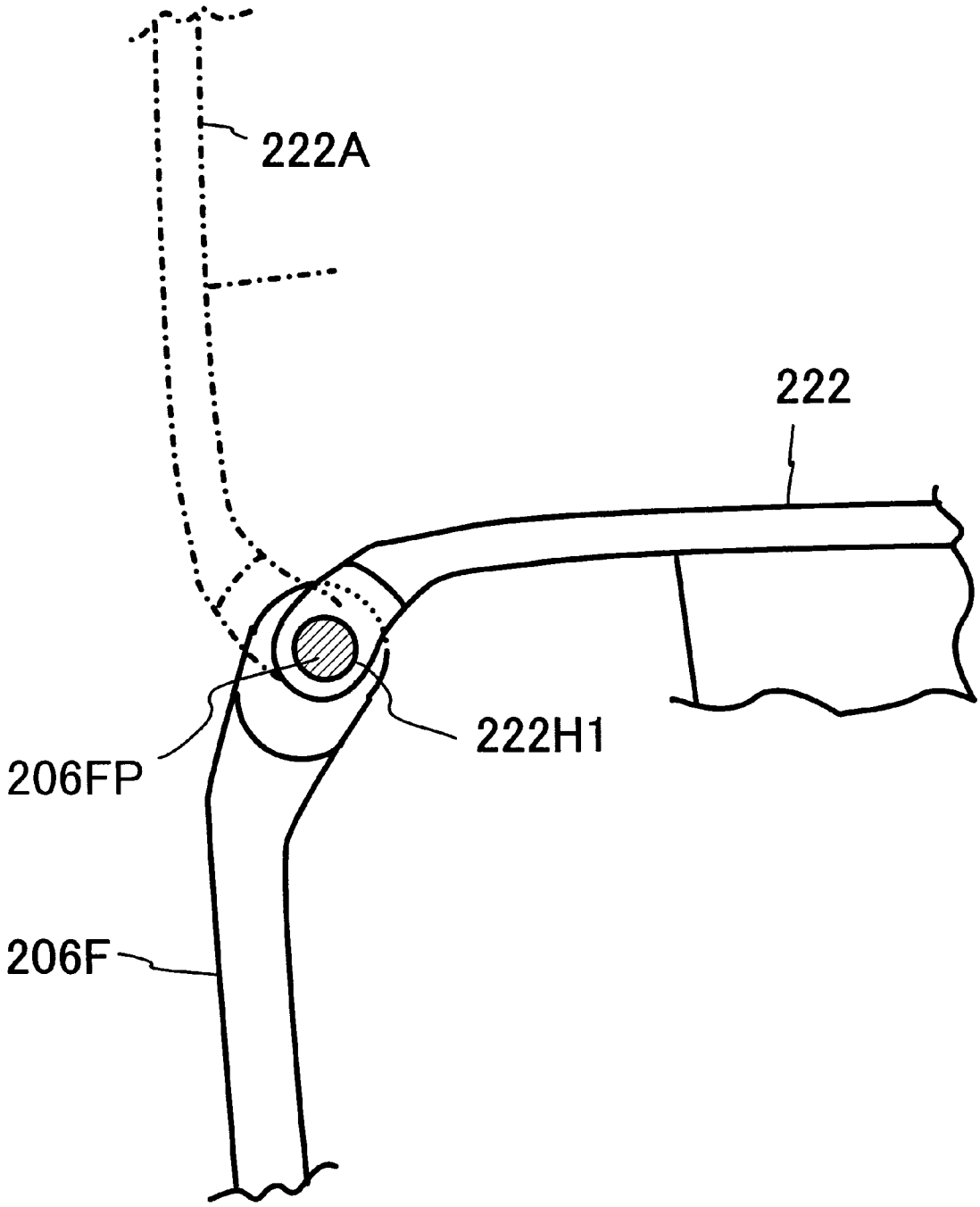
FIG. 6 is a schematic view illustrating still another hinge for connecting the open-and-close cover to the body of the automatic document feeder according to the present invention.

Furthermore, as shown in FIG. 6, a combination of the open-and-close cover 222 having a hole 222H1 at a rear end thereof and the frame 206F of the automatic document feeder 206 having a pin 206FP can also function as the hinge for opening the open-and-close cover 222. This structure also provides cost reduction.

Figure 7:
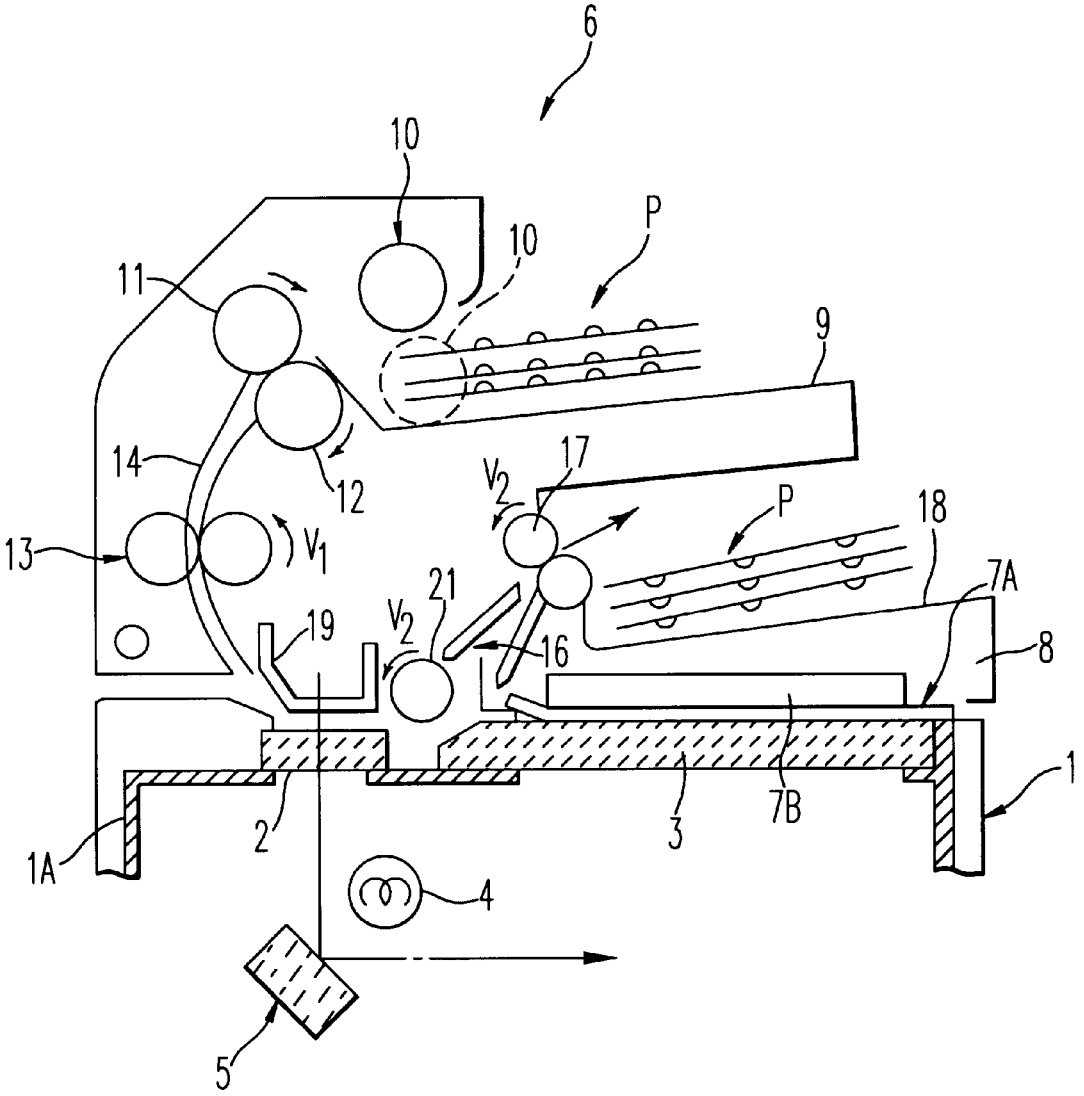
FIG. 7 is an exemplary schematic view illustrating a structure of another automatic document feeder according to a second embodiment of the present invention.

FIG. 7 is a schematic view illustrating a structure of another embodiment of an automatic document feeder 6 according to the present invention mounted on a photocopier 1 as an example of an image processing apparatus. In FIG. 7, the automatic document feeder 6 is schematically illustrated with a non-proportional scale to help understand an internal structure of the automatic document feeder 6 and the image forming apparatus 1. Referring to FIG. 7, the photocopier 1 includes a chassis 1*a*, a strip glass 2, a platen glass 3, an illuminating lamp 4, a mirror 5, and a paper guide 15. The photocopier 1 further includes a lens, an image reading device, such as a charge-coupled-device, a photoconductive drum, a laser writing device, a developing device, a paper transport mechanism, an image transfer device, an image fixing device, and so forth, which are not shown. The size of the platen glass 3 is at least the same size as that of a maximum-sized document that is placed thereon. The strip glass 2 functions as a guide for guiding a sheet of a document to be transported over the strip glass 2 contacting or adjacent to the strip glass 2. The size of the strip glass 2 in the document transporting direction corresponds to a couple of scanning lines read by the image reading device.

The image reading device of the photocopier 1 reads an original document and outputs an image signal in either one of the following two image-reading modes. In a first image-reading mode, as a first step, the illuminating lamp 4 and the mirror 5 are integrally moved and then stopped under the strip glass 2 such that an optical image of a document on the strip glass 2 is formed on the image reading device through a lens. Then, while a sheet of a document is transported on the strip glass 2 toward the right direction in FIG. 7 at a predetermined speed by the automatic document feeder 6, the image reading device reads and outputs a signal of the image of the document. The transportation of the sheet of document can be temporally suspended when the leading edge of the sheet of document reaches the strip glass 2, for example, for making registration between a copying paper and a reproduction image of the document in an image forming process.

In the second image-reading mode, a document is loaded on the platen glass 3. Then, the illuminating lamp 4 and the mirror 5 travel under the platen glass 3 from the right end to the left end of the platen glass 3 in FIG. 7. An optical image of the document is formed on and read by the image reading device and a signal of the image of the document is output.

The writing device exposes a previously uniformly charged photoconductive drum according to the above described image signal, which was obtained by either one of the two image-reading modes, such that an electrostatic latent image according to the image signal is formed on the photoconductive drum. After that, an electrostatic latent image is developed with toner by a developing device. A transfer device transfers the toner image on the photoconductive drum onto a transfer paper fed by a paper transport mechanism. Then, the paper transport mechanism transports a transfer paper carrying the toner image into a fixing device. The fixing device fuses and fixes the toner image on the transfer paper, and discharges the transfer paper outside a body of the photocopier 1 as a completed reproduction of the document.

The automatic document feeder 6 is mounted on the top of the image forming apparatus 1 with a hinge (not shown) such as, for example, the metal hinge 270 shown in FIG. 3. The hinge has an axis which is placed approximately parallel with the top surface of the platen glass 3 at a position behind the chassis 1 a such that the automatic document feeder 6 is rotated around the hinge to expose the surfaces of the platen glass 3 and the strip glass 2. Therefore, in the second image-reading mode, an operator of the automatic document feeder 6 can open the automatic document feeder 6 for laying a document over the top surface of the platen glass 3 and for removing the document therefrom. In addition, in the first image-reading mode, the operator can open the automatic document feeder 6 for removing a jammed sheet of a document, which has been fed to be read by the photocopier 1 and then jammed near the strip glass 2.

Referring to FIG. 7, the automatic document feeder 6 further has a document cover 8 including a cushion 7*a* with a white lining 7*b* facing the platen glass 3. When the automatic document feeder 6 is closed, the document cover 8 presses a document placed on the platen glass 3, which may be either a sheet or a book. A surface of the document carrying an image to be reproduced contacts the top surface of the platen glass 3. When an original document is smaller than a copy paper on which the image of the original document is formed, the white lining 7*b* prevents an area of the copy paper outside of the image of the original document to be formed in black.

Figure 8:
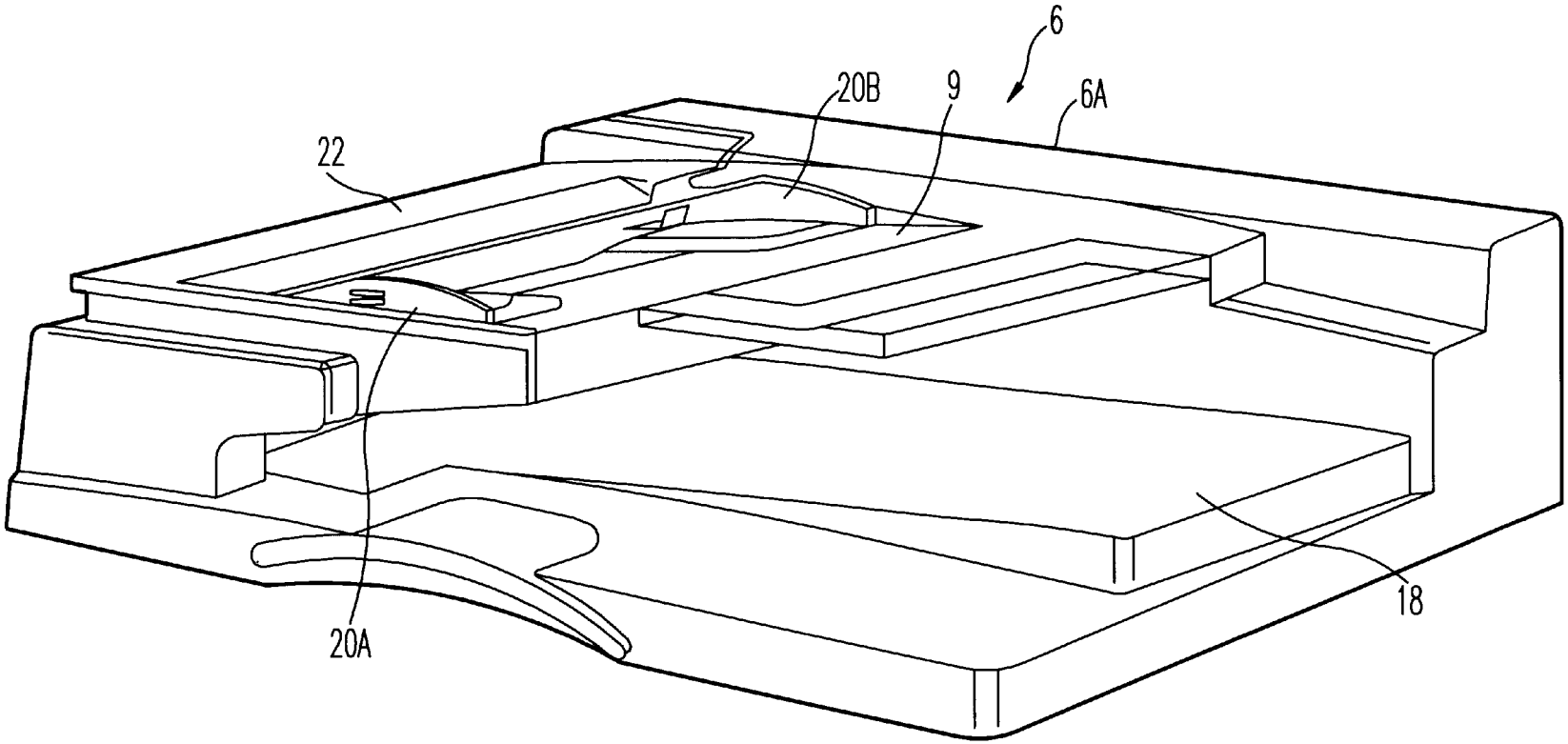
FIG. 8 is an oblique projection view illustrating an exterior of the automatic document feeder shown in FIG. 7 with an open-and-close cover closed.
Figure 9:
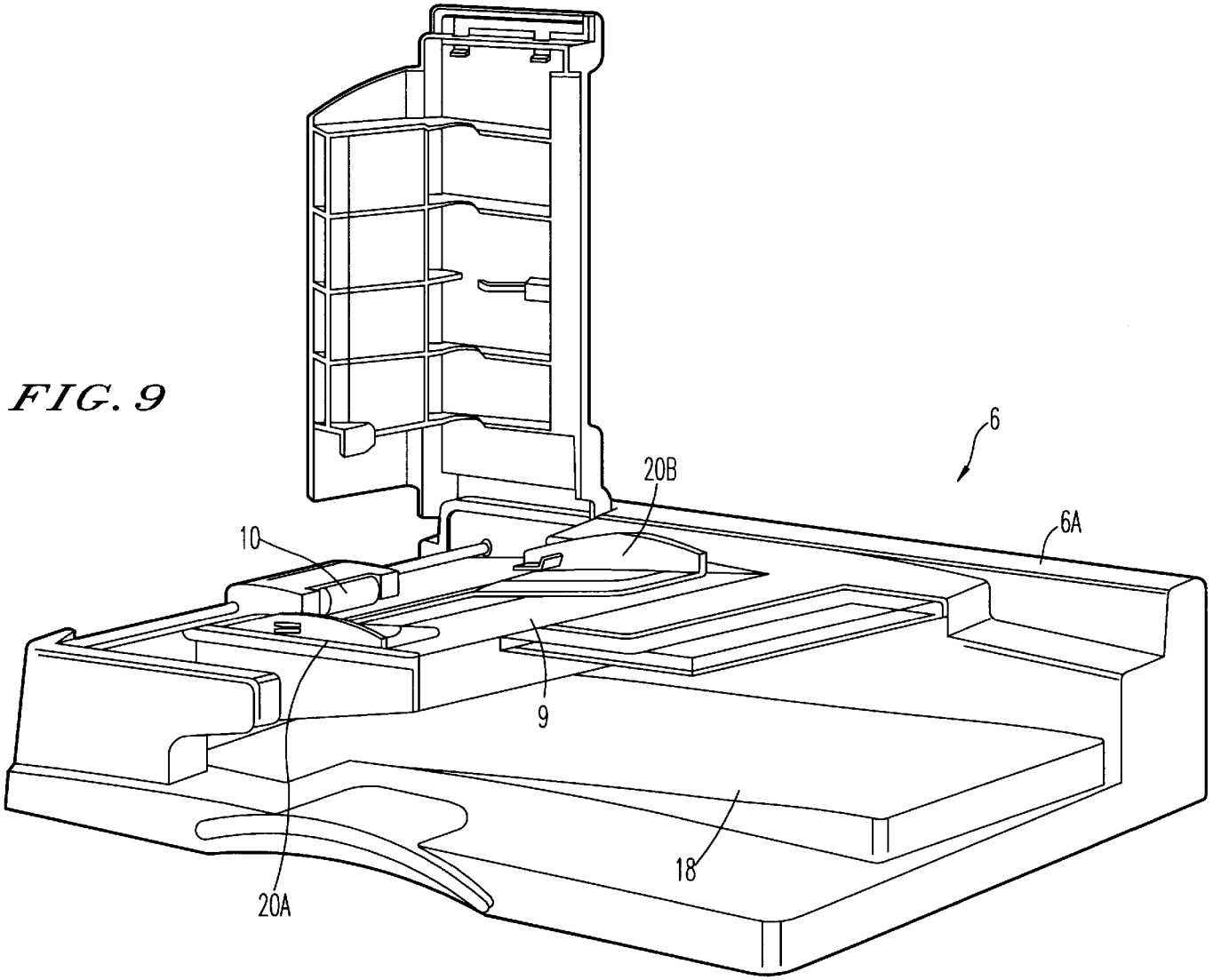
FIG. 9 is an oblique projection view illustrating an exterior of the automatic document feeder shown in FIG. 7 with the open-and-close cover opened.

FIG. 8 and FIG. 9 illustrate an exterior of the automatic document feeder shown in FIG. 7 with an open-and-close cover 22 being closed and opened, respectively. As illustrated in FIG. 8 and FIG. 9, the automatic document feeder 6 includes a main cover 6*a*, and the open-and-close cover 22. A single or plural sheets of a document are placed on the document-feeding tray 9 with the surfaces to be reproduced facing up. Further, the document-feeding tray 9 has a pair of side fences 20*a* and 20*b* in parallel with a direction in which the document is transported. The pair of side fences 20*a* and 20*b* is movable along a direction perpendicular to the document transportation direction to sandwich and guide both side edges of a single or plural sheets of a document in different sizes. Therefore, a sheet of a document is fed inside the automatic document feeder 6 without skew.

Referring back to FIG. 7, the automatic document feeder 6 includes a paper transporting mechanism having a feed-in roller 10, a first transport roller 11, a reverse roller or paper-separating roller 12, a second transport roller pair 13, a white guide 19, a third transport roller 21, an exit roller pair 17, a first paper path 14, and a second paper path 16. The feed-in roller 10, the first transport roller 11, the reverse roller 12, the second transport roller pair 13, and the third transport roller 21 are arranged along the first paper path 14 and the exit roller pair 17 are arranged along the second paper path 16.

The feed-in roller 10 is movable between the position indicated by a solid line and the position indicated by a dash line in FIG. 7 to pull a top sheet out from plural sheets of a document P piled on the document-feeding tray 9 in various thicknesses. The feed-in roller 10 is automatically located at a position contacting the top sheet of plural sheets of a document P, for example by its own weight.

The white guide 19 and the strip glass 2 form a paper path as a portion of the first paper path 14 to guide a document being transported. The gap between the white guide 19 and the strip glass 2 is set, for example, to 2 mm, such that an optical image of the document is formed on the image reading device in a predetermined depth of focus of a lens. In addition, the white guide 19 scatteringly reflects light emitted from the illuminating lamp 4 and impinged upon a position of the white guide 19 not covered by a document being transported. Thereby, even when the document is smaller than a copy reproducing paper, the area of the copy paper outside of the image is prevented from being formed in black.

The third transport roller 21 is arranged in contact with the paper guide 15 of the photocopier 1, and the third transport roller 21 pinches and transports a sheet of a document into the second paper path 16. The paper guide 15 is placed between the strip glass 2 and the platen glass 3, and a right end of paper guide 15 is placed slightly inside the second paper path 16, as shown in FIG. 7, to guide a sheet of a document smoothly into the second paper path 16.

In the first image-reading mode, after a copy reproducing operation starts, each of plural sheets of document P piled on the document-feeding tray 9 is fed out one by one and is transported at a predetermined velocity V1 by the paper transporting mechanism, and is then discharged and stacked on the document-receiving tray 18. The feed-in roller 10 first pulls the top sheet out from the pile of documents P on the document-feeding tray 9 and feeds the sheet toward the first transport roller 11. The first transport roller 11 and the second transport roller pair 13 transport the sheet of the document at the predetermined velocity V1 toward the third transport roller 21.

A circumference velocity V2 of the third transport roller 21 and the exit roller pair 17 can be substantially the same as that of the second transport roller pair 13, i.e., V1. However, the circumference velocity V2 can be slightly greater than V1, for example, 101% of V1, to prevent the sheet of the document from fluttering while being transported. The third transport roller 21 and the exit roller pair 17 can be driven by a motor (not shown) via a torque-limiting device (not shown) to avoid the document sheet from being tensed too much. Discharged document sheets are stacked on the document-receiving tray 18 with the surfaces having been read at the strip glass 2 facing down.

When plural sheets of the document P have been pulled out together from the document-feeding tray 9, the reverse roller 12 rotates in a clockwise direction so that only the top document of the plural sheets of the document, which is contacting the first transport roller 11, is further fed into the first paper path 14, blocking the other sheets of the plural sheets of the document which had been inadvertently pulled out together with the top document sheet. In other words, the reverse roller 12 functions as a sheet separator. The reverse roller 12 can be replaced by a stationary friction pad made of, such as, synthetic rubber or a cork sheet for blocking sheets except the top sheet at the top of the stack of documents P on the document-feeding tray 9 from being fed.

Referring to FIG. 8 and FIG. 9, the open-and-close cover 22 is rotatively mounted on the body of the automatic document feeder 6 with a hidden hinge inside the main cover 6*a*, such as, for example, a hinge as shown in FIG. 6. The axis of the hinge is placed perpendicular to the axis of the feed-in roller 10 and is approximately parallel with the top surface of the platen glass 3 at a rear part of the body of the automatic document feeder 6. The open-and-close cover 22 can be opened, for example, by as much as a 90 degree angle as shown in FIG. 9. When the open-and-close cover 22 is opened, the feed-in roller 10, the first transport roller 11, the reverse roller 12, the second transport roller pair 13, and the first paper path 14 are exposed.

A sheet of a document may be jammed on the way from the document-feeding tray 9 to the document-receiving tray 18 due to, for example, a blackout of power supply, too much crinkle and/or curl in the sheet of the document, or the sheet being too thin, and so forth. If such a sheet jam occurs, the operator can open the open-and-close cover 22 and can remove the jammed sheet of the document from around the feed-in roller 10, the first transport roller 11, the reverse roller 12, the second transport roller pair 13, or the first paper path 14. In addition, because the hinge of the open-and-close cover 22 is located at a rear side of the automatic document feeder 6, enough room for removing a jammed sheet is obtained at the left side of the first paper path 14 and a good operability is accomplished. Further, a floor space occupied by the automatic document feeder 6 does not increase when the open-and-close cover 22 is opened.

Further, the automatic document feeder 6 can be upwardly opened such that the jammed sheet around the strip glass 2 or the paper guide 15 can be found also. The rotating direction for opening the automatic document feeder 6 is substantially the same as that of the open-and-close cover 22, and thereby the operator can handle a jam recovery operation in a simple manner.

In the second image-reading mode, the operator first upwardly opens the automatic document feeder 6 and places a sheet of a document or a book with the surface carrying an image to be reproduced contacting the platen glass 3, and then closes the automatic document feeder 6 to press the document against the platen glass 3. When the operator presses a start button (not shown), the copy reproduction operation described above starts.

Figure 10:
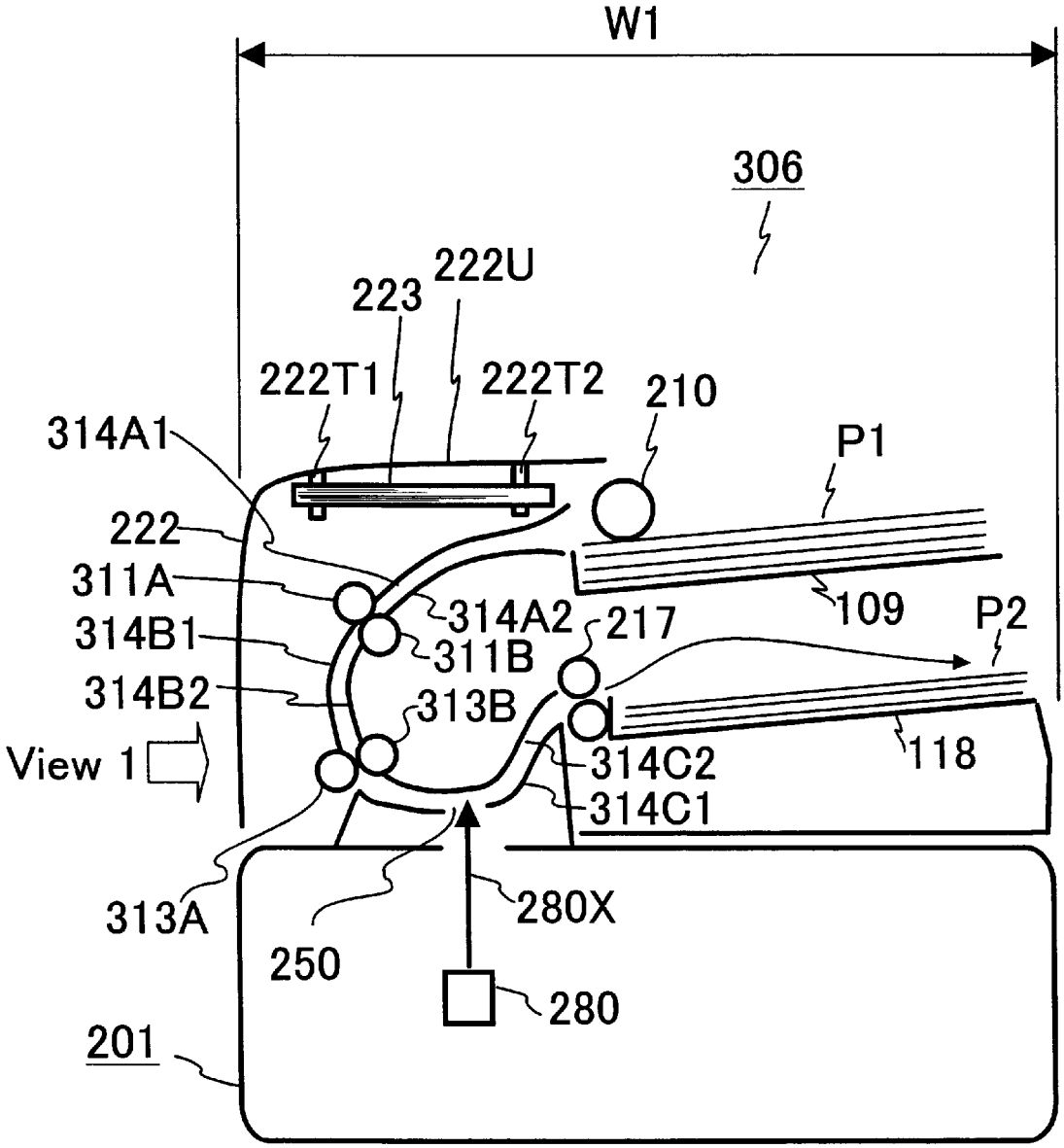
FIG. 10 is a schematic view illustrating a structure of another automatic document feeder according to a third embodiment of the present invention.
Figure 11:
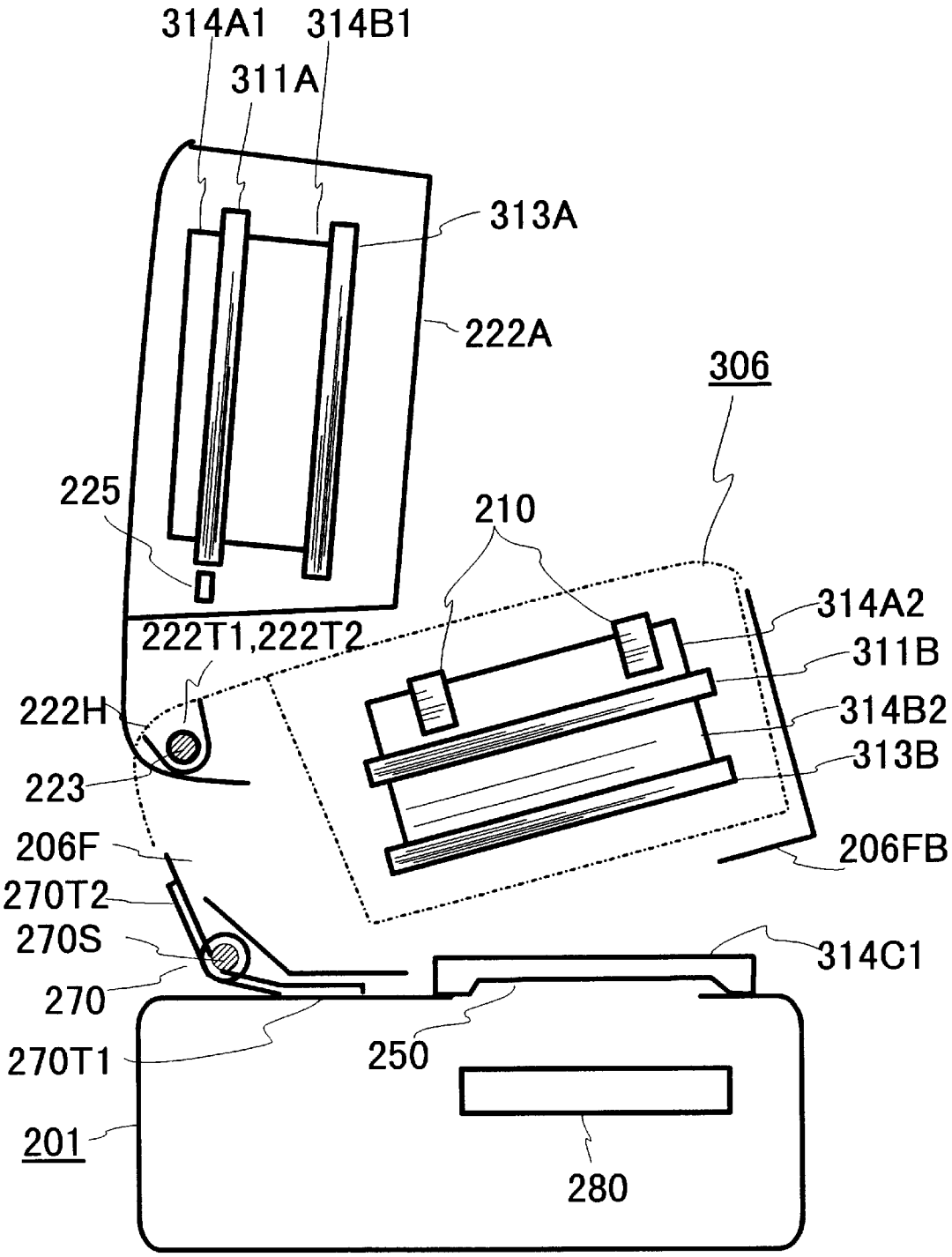
FIG. 11 is a schematic side view illustrating a structure of the automatic document feeder of FIG. 10 with an open-and-close cover and automatic document feeder opened.
Figure 12:
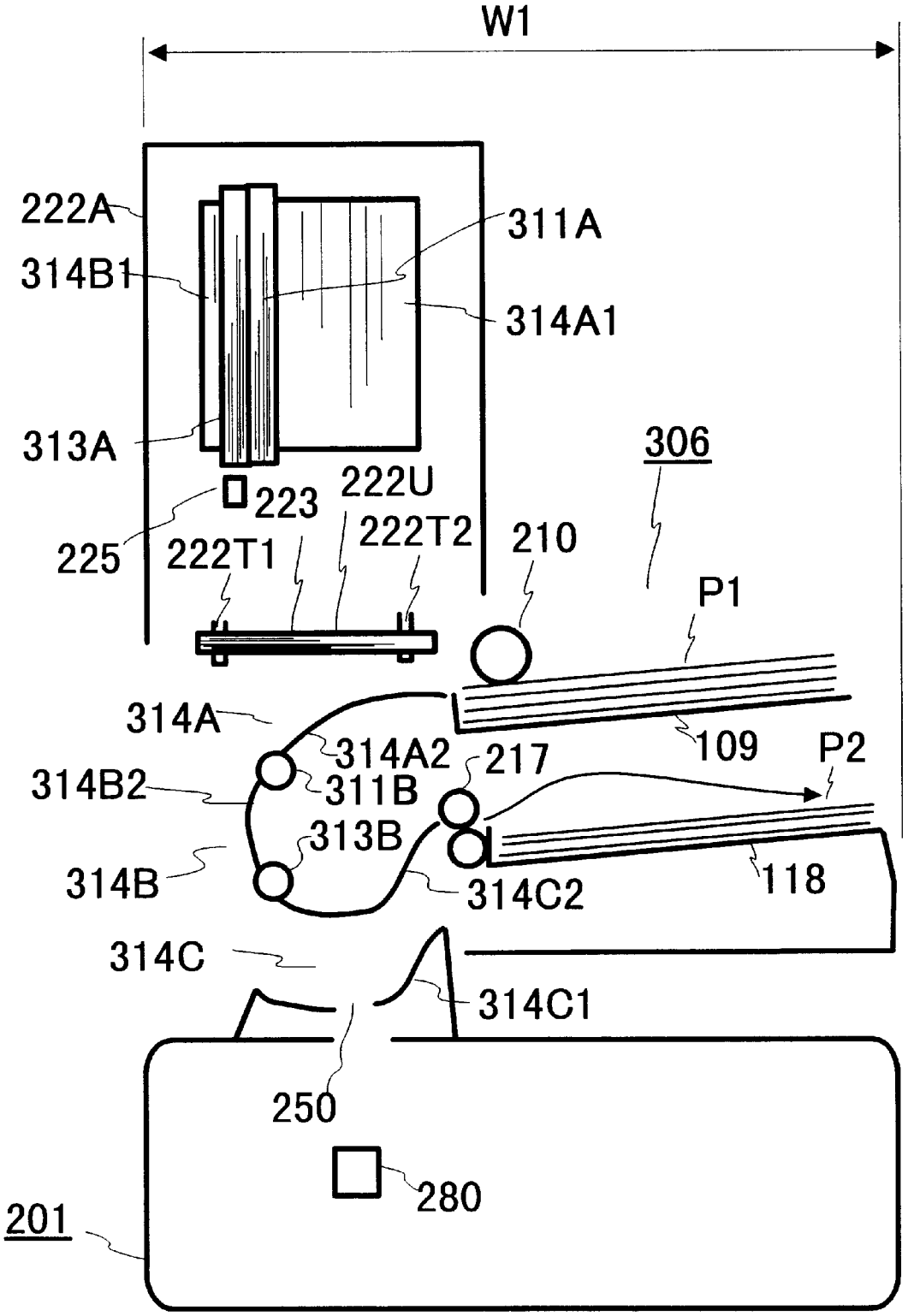
FIG. 12 is a schematic front view illustrating a structure of the automatic document feeder of FIG. 10 with the open-and-close cover and automatic document feeder opened.

FIG. 10, FIG. 11, and FIG. 12, are schematic views illustrating a structure of still another embodiment of an automatic document feeder 306 according to the present invention, which is mounted on an image scanner 201. The automatic document feeder 306 includes an open-and-close cover 222, a feed-in roller 210, a first transport roller 311A, a reverse roller or paper-separate roller 311B, a second transport roller 313B, a pinch roller 313A, an upper guide plate 314A1 and a lower guide plate 314A2 of a first paper path 314A, a left guide plate 314B1 and a right guide plate 314B2 of a second paper path 314B, and a driving device 225. In this embodiment, the first transport roller 311A, the pinch roller 313A, the upper guide plate 314A1, the left guide plate 314B1, and the driving device 225 are mounted on the open-and-close cover 222 for further enhancing operability of removing a jammed sheet of a document. The feed-in roller 210, the reverse roller 311B, the second transport roller 313B, the lower guide plate 314A2, and the right guide plate 314B2 are mounted on the frame of the automatic document feeder 306.

The first transport roller 311A is rotated in a clockwise direction by the driving device 225, such as, for example, an electric motor. Gear trains that are coupled to an electrical motor installed inside the main body of the automatic document feeder 306 can also be utilized. FIG. 11 is a side view of the automatic document feeder 306 shown in FIG. 10 from the direction indicated by "View 1", and illustrates a case that the automatic document feeder 306 and the open-and-close cover 222 are opened at a 15 degree angle and at a 70 degree angle, respectively. FIG. 12 is a front view of the automatic document feeder 306 shown in FIG. 10 when both the automatic document feeder 306 and the open-and-close cover 222 are opened. As these FIGS. 10, 11, and 12 show, when the open-and-close cover 222 is closed, the pinch roller 313A presses against the second transport roller 313B. When the open-and-close cover 222 is opened, the pinch roller 313A, the upper guide plate 314A1, the left guide plate 314B1, and the driving device 225 are opened as well, and thereby, removing a sheet of a document around the first paper path 314A and the second paper path 314B is made easy.

A paper guide plate 314C1 with a window 250, which is arranged along third paper path 314C2, is attached on the image scanner 201. The automatic document feeder 306 is mounted on the top of the image scanner 201 with a hinge 270, which allows the automatic document feeder 306 to be opened at a 15 degree angle. Therefore, as FIG. 11 and FIG. 12 illustrate, when the automatic document feeder 306 is opened, paper guide plate 314C1 is left on the image scanner 201, and a relatively large room for removing a jammed sheet of document around the third paper path 314C is obtained.

As described above, an automatic document feeder of the present invention can be utilized in a relatively small space with enough room secured for removing a jammed sheet of a document. Further, an automatic document feeder of the present invention, as described above, provides improved operability for a document jam recovery.

Obviously, numerous additional modifications and variations of the present invention are possible in light of the above teachings. In particular, features described for certain embodiments may be employed in a logical manner to other embodiments described herein. It is therefore to be understood that within the scope of the appended claims, the present invention may be practiced otherwise than as specifically described herein.

This document is based on Japanese patent application No. 10-100995 filed in the Japanese Patent Office on Apr. 13, 1998, and the entire contents of which are hereby incorporated by reference.

What is claimed as new and is desired to be secured by Letters Patents of the United States:

1. An automatic document feeder comprising:

document-loading means for loading at least one sheet thereupon;

document-receiving means arranged below the document-loading means for receiving and stacking the at least one sheet one by one transported from the document-loading means;

sheet-guiding means for guiding transportation of the at least one sheet from the document-loading means to the document-receiving means, said sheet-guiding means reversing a direction of transport of the at least one sheet;

sheet-transporting means for transporting the at least one sheet one by one along the sheet-guiding means from the document-loading means to the document-receiving means;

open-and-close covering means for covering and exposing an upper portion and a side of the sheet-guiding means and the sheet-transporting means; and first rotative connecting means for connecting the open-and-close covering means and a body of the automatic document feeder at a rear part thereof such that the open-and-close covering means opens upward in a direction perpendicular to a sheet-transporting-direction by the sheet-transporting means.

2. The automatic document feeder according to claim 1, wherein the sheet-transporting means includes paper-separating means for allowing transporting of only a top sheet of the at least one sheet at one time.

3. The automatic document feeder according to claim 1, further comprising second rotative connecting means for connecting an image processing apparatus and the body of the automatic document feeder at a rear part thereof such that the body of the automatic document feeder opens upward.

4. The automatic document feeder according to claim 3, wherein an axis of the second rotative connecting means is parallel to an axis of the first rotative connecting means such that the body of the automatic document feeder is rotated in substantially a same direction of the rotation of the open-and-close covering means.

5. The automatic document feeder according to claim 3, further comprising document covering means for covering and pressing the at least one sheet against a platen glass of the image processing apparatus.

6. The automatic document feeder according to claim 1, wherein, the sheet-transporting means includes a plurality of sheet-transporting devices, and at least one of the plurality of sheet-transporting devices is mounted on the open-and-close covering means.

7. The automatic document feeder according to claim 1, wherein the sheet-guiding means includes a plurality of sheet-guiding devices, and at least one of the plurality of sheet-guiding devices is mounted on the open-and-close covering means.

8. An automatic document feeder comprising:

a document-feeding tray configured to load at least one sheet thereupon;

a document-receiving tray positioned below the document-feeding tray and configured to receive and stack the at least one sheet one by one transported from the document-feeding tray;

a sheet path configured to guide the at least one sheet transported from the document-feeding tray to the document-receiving tray;

a sheet-transporting mechanism configured to transport the at least one sheet one by one along the sheet path from the document-feeding tray to the document-receiving tray, said sheet path reversing a direction of transport of the at least one sheet;

an open-and-close cover configured to cover and expose an upper portion and a side of the sheet path and the sheet-transporting mechanism; and a first hinge configured to connect the open-and-close cover and a body of the automatic document feeder at a rear part thereof such that the open-and-close cover opens upward in a direction perpendicular to a sheet-transporting-direction by the sheet-transporting mechanism.

9. The automatic document feeder according to claim 8, wherein the sheet-transporting mechanism includes a paper-separating roller configured to allow transporting of only a top sheet of the at least one sheet at one time.

10. The automatic document feeder according to claim 8, further comprising a second hinge configured to connect an image processing apparatus and the body of the automatic document feeder at a rear part thereof such that the body of the automatic document feeder opens upward.

11. The automatic document feeder according to claim 10, wherein an axis of the second hinge is parallel to an axis of the first hinge such that the body of the automatic document feeder is rotated in substantially a same direction of the rotation of the open-and-close cover.

12. The automatic document feeder according to claim 8, further comprising a document cover that covers and presses the at least one sheet against a platen glass.

13. The automatic document feeder according to claim 8, wherein the sheet-transporting mechanism includes a plurality of sheet-transporting rollers, and at least one of the plurality of sheet-transporting rollers is mounted on the open-and-close cover.

14. The automatic document feeder according to claim 8, wherein the sheet path includes a plurality of sheet-guiding plates, and at least one of the plurality of sheet-guiding plates is mounted on the open-and-close cover.

15. The automatic document feeder according to claim 8, wherein the first hinge is integrally molded with the open-and-close cover and connects to a frame of the automatic document feeder.

16. An automatic document processing system comprising:

an automatic document feeder having:

a document-feeding tray configured to stack at least one sheet thereupon;

a document-receiving tray positioned below the document-feeding tray and configured to receive and stack the at least one sheet one by one transported from the document-feeding tray;

a sheet path configured to guide the at least one sheet transported from the document-feeding tray to the document-receiving tray, said sheet path reversing a direction of transport of the at least one sheet;

a sheet-transporting mechanism configured to transport the at least one sheet one by one along the sheet path from the document-feeding tray to the document-receiving tray;

an open-and-close cover configured to cover and expose an upper portion and a side of the sheet path and the sheet-transporting mechanism; and a first hinge configured to connect the open-and-close cover and a body of the automatic document feeder at a rear part thereof such that the open-and-close cover opens upward in a direction perpendicular to a sheet-transporting-direction by the sheet-transporting mechanism;

an image processing apparatus configured to read and process image information carried on the at least one sheet transported by the sheet-transporting mechanism of the automatic document feeder; and a second hinge configured to connect the image processing apparatus and the body of the automatic document feeder at a rear part thereof such that the body of the automatic document feeder opens upward.

17. The automatic document processing system according to claim 16, wherein the sheet path includes a plurality of sheet-guiding plates, and at least one of the plurality of sheet-guiding plates is mounted on the image processing apparatus.

18. An operating method of an automatic document feeder comprising steps of:

loading at least one sheet on a document-feeding tray;

activating the automatic document feeder to transport the at least one sheet one by one from the document-feeding tray to a document-receiving tray;

rotatively opening upward an open-and-close cover to expose a portion of a sheet path which guides the at least one sheet transported from the document-feeding tray to the document-receiving tray, when the at least one sheet has jammed on the sheet path;

removing the jammed sheet from the sheet path;

closing the open-and-close cover;

rotatively opening the automatic document feeder in substantially a same direction as the opening direction of the open-and-close cover to expose other portions of the sheet path;

removing the jammed sheet of document away from the other portions of the sheet path; and closing the automatic document feeder.

19. An operating method of an automatic document feeder comprising steps of:

loading at least one sheet on a document-feeding tray;

activating the automatic document feeder to transport the at least one sheet one by one from the document-feeding tray to a document-receiving tray;

rotatively opening upward the automatic document feeder to expose a portion of a sheet path which guides the at least one sheet transported from the document-feeding tray to the document-receiving tray, when the at least one sheet has jammed on the path;

removing the jammed sheet from the sheet path;

closing the automatic document feeder;

rotatively opening an open-and-close cover in substantially a same direction of the opening direction as the automatic document feeder to expose other portions of the sheet path;

removing the jammed sheet of document away from the other portions of the sheet path; and closing the open-and-close cover.

* * * * *